US008209780B1

(12) United States Patent
Lemire

(10) Patent No.: US 8,209,780 B1
(45) Date of Patent: Jul. 3, 2012

(54) PIVOTING HELMET MOUNT

(75) Inventor: Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 754 days.

(21) Appl. No.: 12/259,010

(22) Filed: Oct. 27, 2008

Related U.S. Application Data

(60) Provisional application No. 60/982,533, filed on Oct. 25, 2007.

(51) Int. Cl.
*A42B 1/24* (2006.01)

(52) U.S. Cl. ..... 2/422; 2/6.6; 359/409

(58) Field of Classification Search ..... 2/410, 6.6, 2/422; 359/409
See application file for complete search history.

(56) References Cited

U.S. PATENT DOCUMENTS

| | | | | | |
|---|---|---|---|---|---|
| 4,156,292 | A | * | 5/1979 | Helm et al. | 2/422 |
| 4,449,787 | A | | 5/1984 | Burbo et al. | |
| 4,577,347 | A | * | 3/1986 | Connon | 2/6.2 |
| 4,689,834 | A | | 9/1987 | McCarthy et al. | |
| 4,901,210 | A | | 2/1990 | Hanabusa | |
| 5,367,402 | A | * | 11/1994 | Holmes et al. | 359/400 |
| 5,412,811 | A | * | 5/1995 | Hildenbrand et al. | 2/10 |
| 5,467,479 | A | | 11/1995 | Mattes | |
| 5,471,678 | A | * | 12/1995 | Dor | 2/6.7 |
| 5,506,730 | A | | 4/1996 | Morley et al. | |
| 5,535,053 | A | | 7/1996 | Baril et al. | |
| 5,542,627 | A | | 8/1996 | Crenshaw et al. | |
| 5,581,806 | A | * | 12/1996 | Capdepuy et al. | 2/6.2 |
| 5,703,354 | A | | 12/1997 | Wannagot et al. | |
| D392,071 | S | * | 3/1998 | Berke | D29/103 |
| D402,421 | S | * | 12/1998 | Berke | D29/122 |
| 5,914,816 | A | * | 6/1999 | Soto et al. | 359/630 |
| 6,457,179 | B1 | | 10/2002 | Prendergast | |
| 6,462,867 | B2 | * | 10/2002 | Choinere | 359/409 |
| 6,472,776 | B1 | | 10/2002 | Soto et al. | |
| 6,560,029 | B1 | | 5/2003 | Dobbie et al. | |
| 6,662,370 | B1 | | 12/2003 | Buchanan, Jr. | |
| 6,957,449 | B2 | * | 10/2005 | Prendergast | 2/422 |
| 7,219,370 | B1 | | 5/2007 | Teetzel et al. | |
| 7,735,159 | B2 | * | 6/2010 | Prendergast | 2/422 |
| 2005/0111097 | A1 | * | 5/2005 | Iannarelli et al. | 359/409 |
| 2007/0214551 | A1 | | 9/2007 | Teetzel et al. | |
| 2008/0263752 | A1 | * | 10/2008 | Solinsky et al. | 2/422 |

FOREIGN PATENT DOCUMENTS

FR 2677604 A1 12/1991

OTHER PUBLICATIONS

U.S. Appl. No. 12/117,704, filed May 8, 2008.
U.S. Appl. No. 12/759,435, filed Apr. 13, 2010.
U.S. Appl. No. 12/791,063, filed Jun. 1, 2010.

* cited by examiner

*Primary Examiner* — Christopher Harmon
(74) *Attorney, Agent, or Firm* — McLane, Graf, Raulerson & Middleton, Professional Association

(57) ABSTRACT

A mounting device for mounting an associated optical device on an associated helmet includes a first pivot arm assembly removably attachable to the associated helmet. A second pivot arm assembly is pivotally attached to the first pivot arm assembly and is rotatable about a first horizontal axis. A optical device mounting arm assembly is rotatably attached to the second pivot arm assembly. The optical device mounting arm assembly rotatable about a first vertical axis relative to the second pivot arm assembly.

18 Claims, 12 Drawing Sheets

PIVOTING HELMET MOUNT

CROSS-REFERENCE TO RELATED APPLICATION

This application claims the benefit of priority under 35 U.S.C. §119(e) based on U.S. provisional patent application No. 60/982,533, filed Oct. 25, 2007. The aforementioned provisional application is incorporated herein by reference in its entirety.

INCORPORATION BY REFERENCE

This application is related to U.S. provisional application No. 60/509,136 filed Oct. 6, 2003; U.S. application Ser. No. 10/959,906 filed Oct. 6, 2004 (U.S. Pat. No. 7,219,370); U.S. application Ser. No. 11/804,813 filed May 21, 2007; U.S. provisional application No. 60/928,239 filed May 8, 2007; and U.S. application Ser. No. 12/117,704 filed May 8, 2008. Each of the aforementioned applications is incorporated herein by reference in its entirety.

BACKGROUND

The present disclosure relates to an improved system for mounting an optical device, including without limitation a night vision goggle (NVG) or electronic night vision goggle (eNVG) device, to headgear such as a field helmet.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
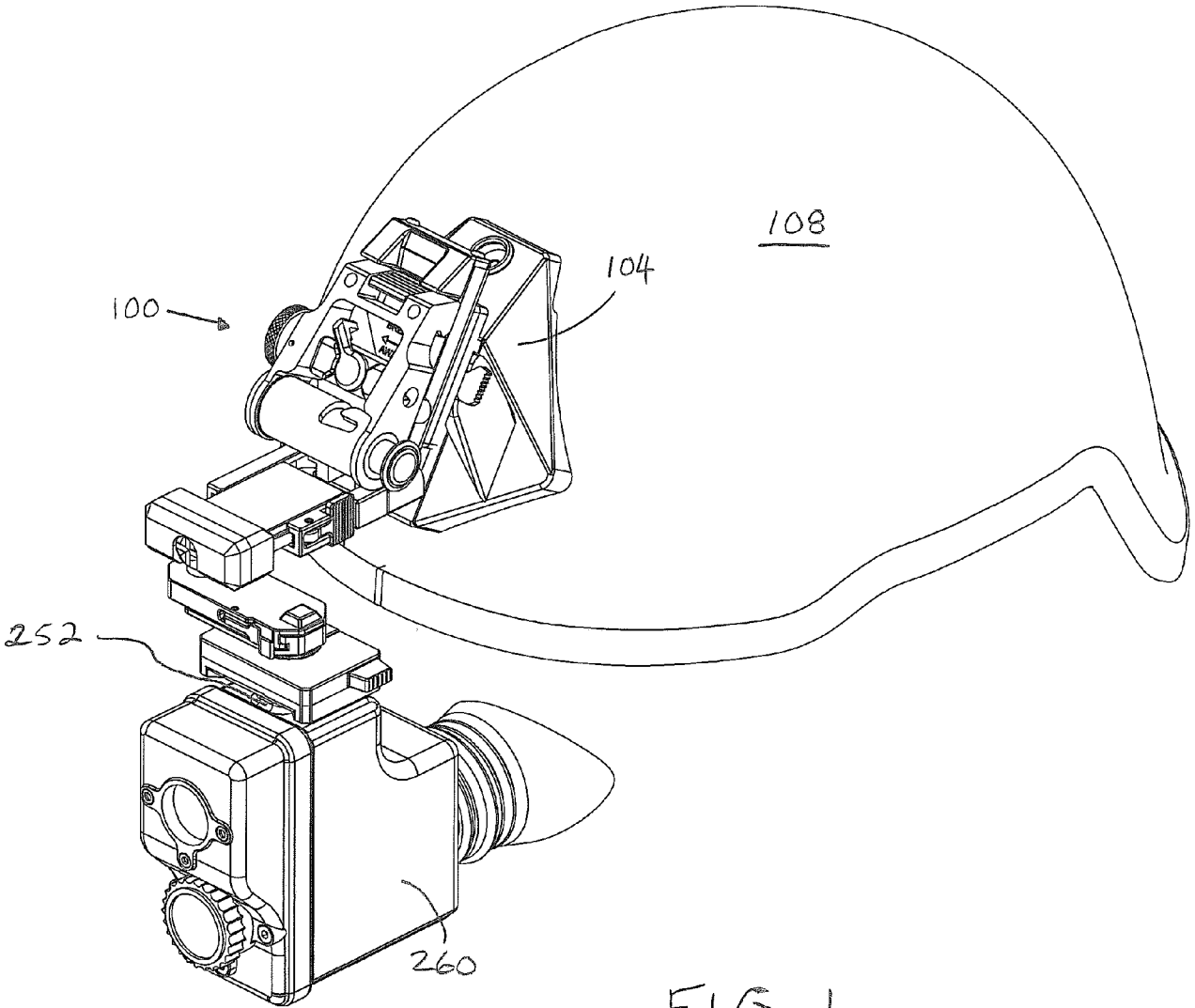
FIG. 1 is an isometric view taken generally from the front and side of an associated helmet carrying an associated optical device using a helmet mount system according to an exemplary embodiment wherein the optical device is positioned in front of the left eye the user.
Figure 2:
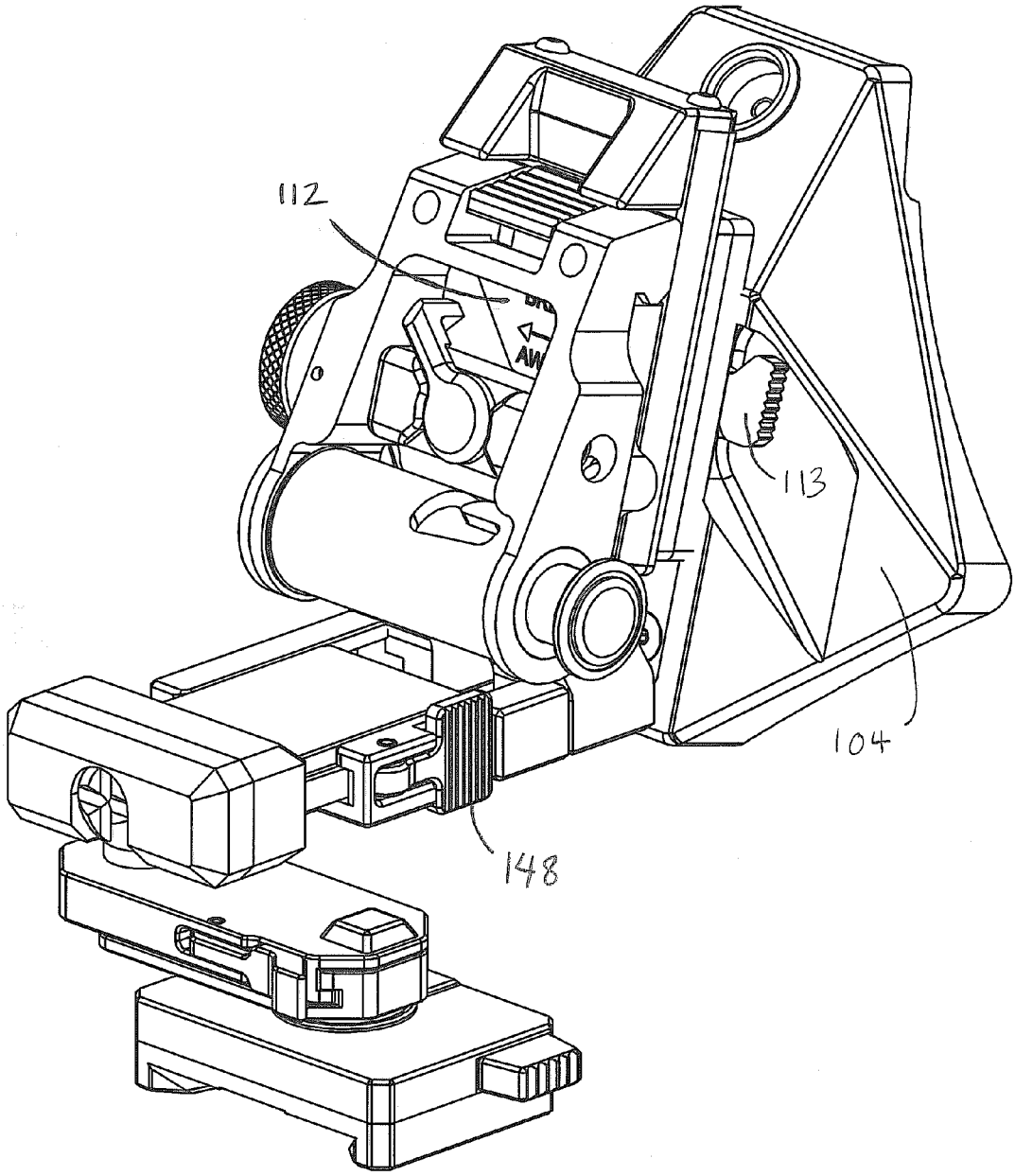
FIG. 2 is an enlarged view of the helmet mount system shown in FIG. 1 wherein the optical device mounting shoe is positioned before the left eye the user.
Figure 3:
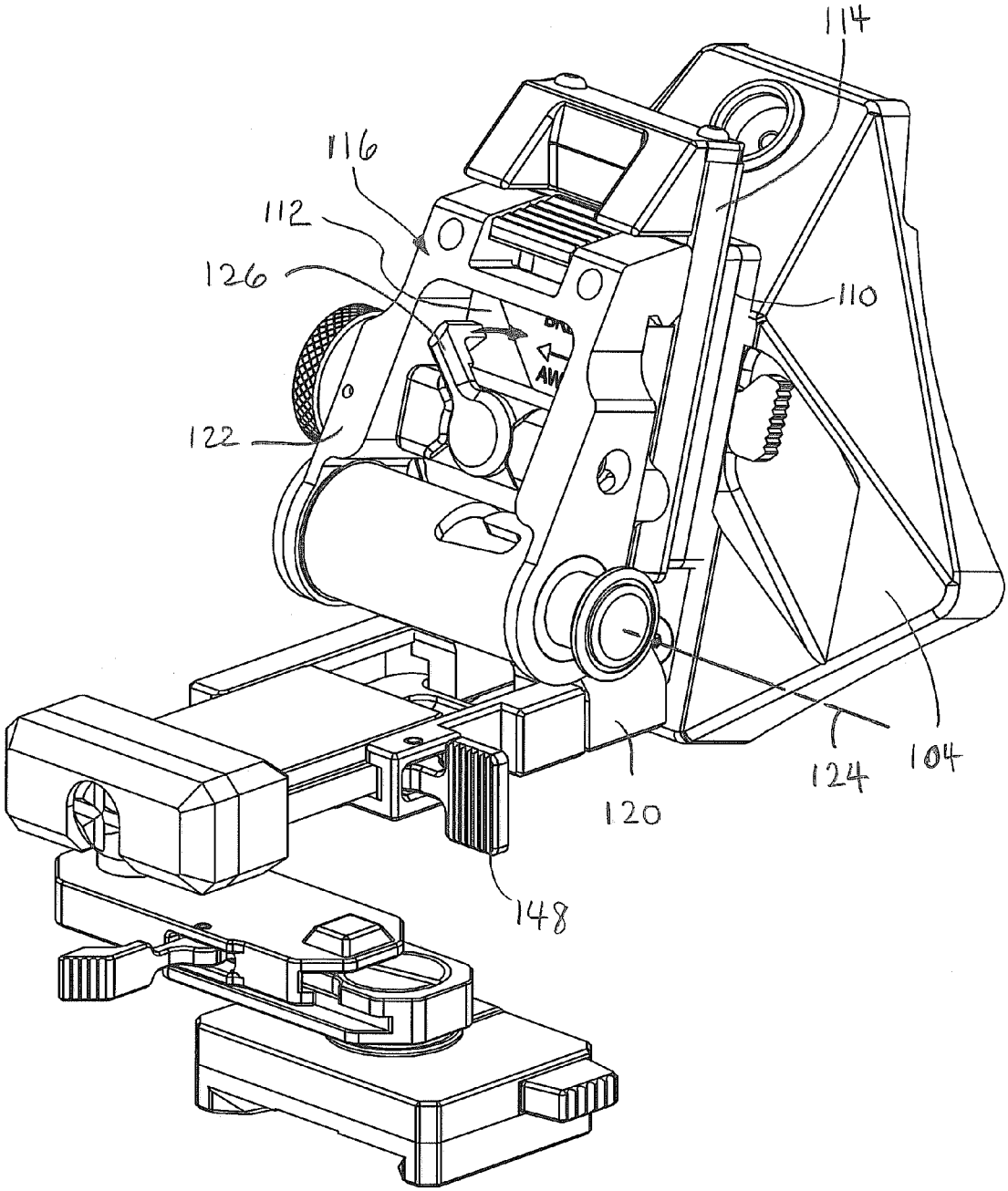
FIG. 3 is an enlarged view of the helmet mount system shown in FIG. 1 wherein the optical device mounting shoe is positioned before the left eye the user, and showing the for and aft adjustment lever in the unlocked position.
Figure 4:
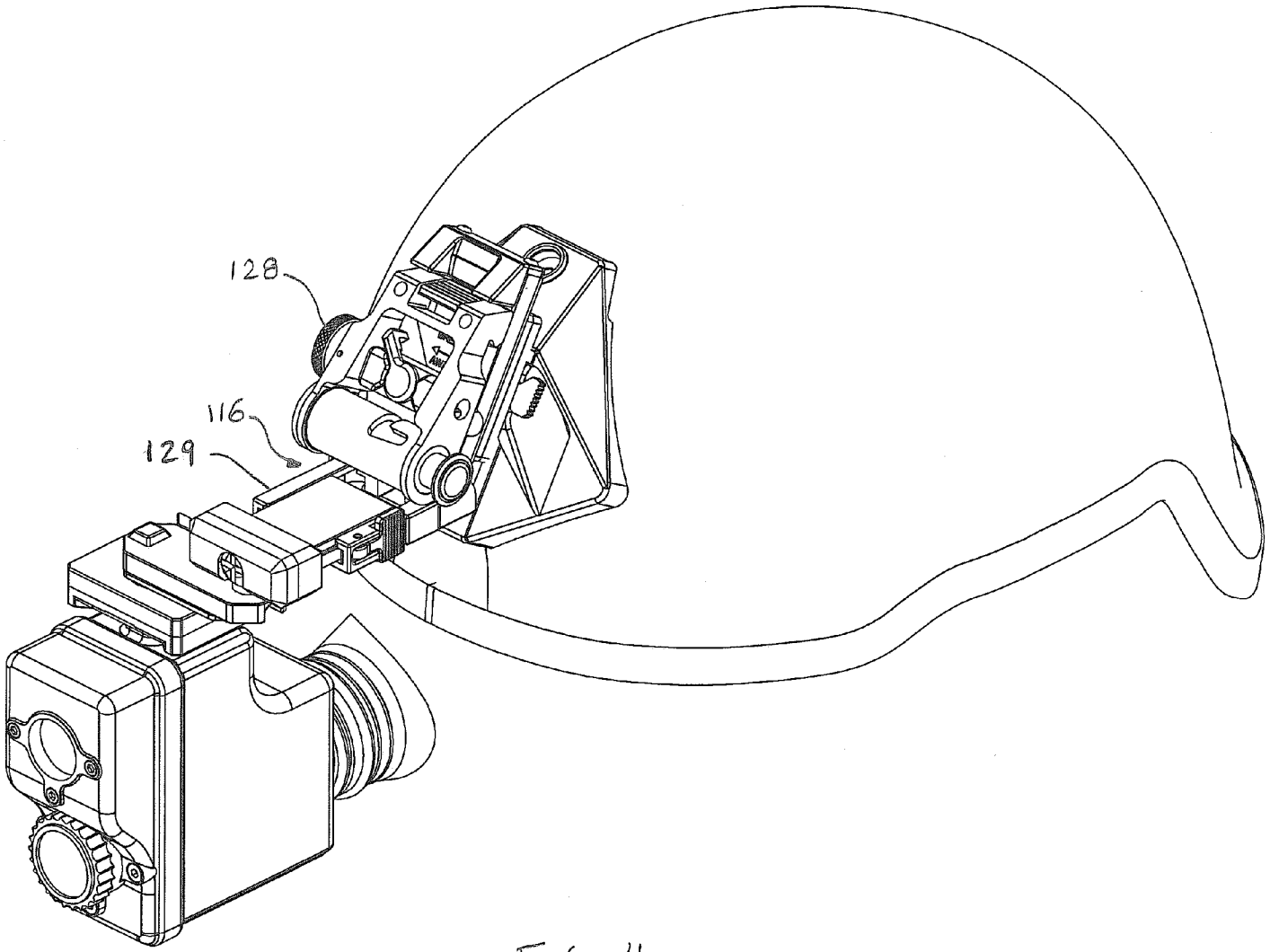
FIG. 4 is an isometric view of the embodiment appearing in FIG. 1, wherein the optical device is positioned in front of the right eye the user.
Figure 5:
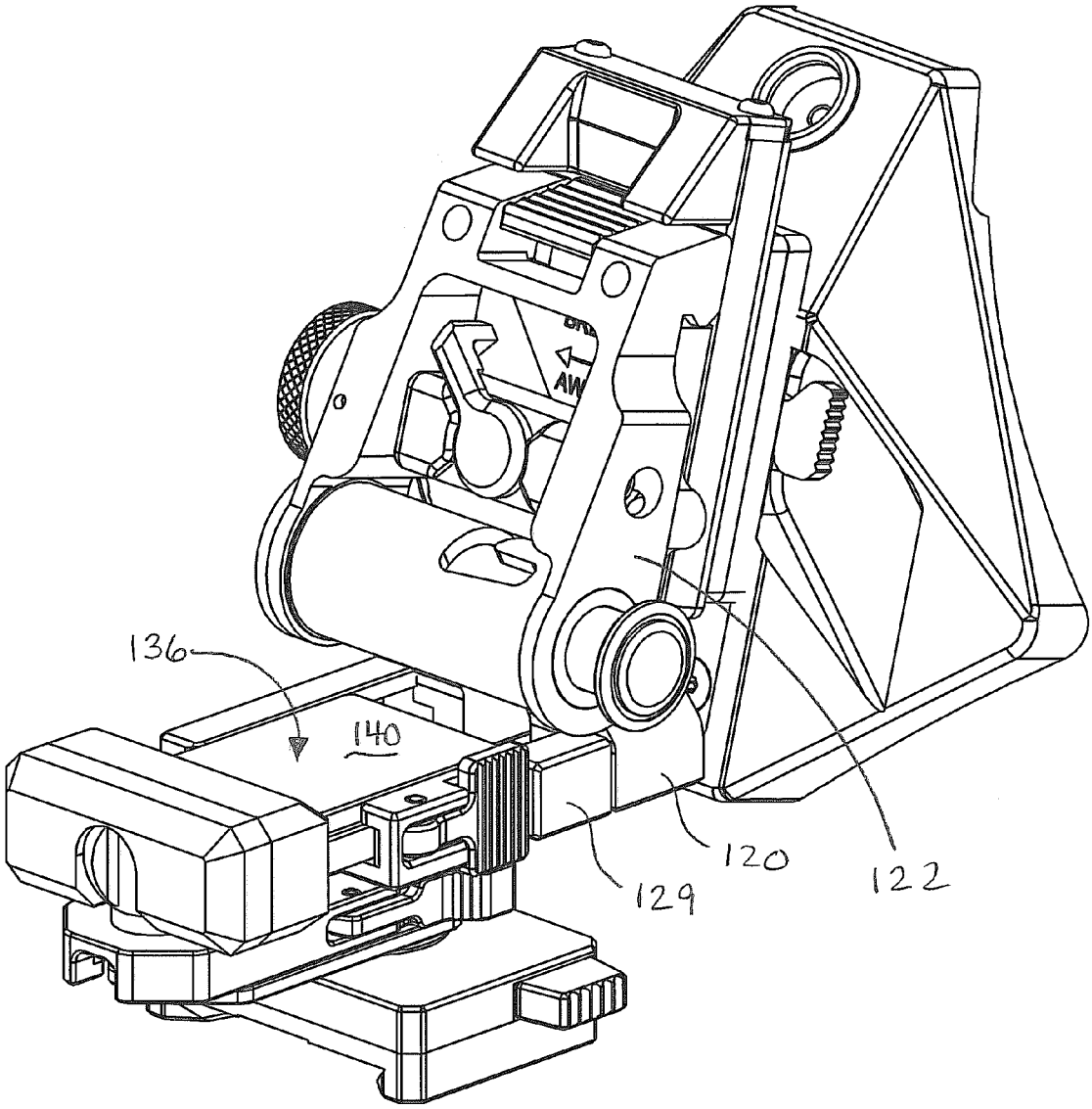
FIG. 5 is an enlarged view of the helmet mount system shown in FIG. 3 wherein the mounting shoe is moved to a center position.
Figure 6:
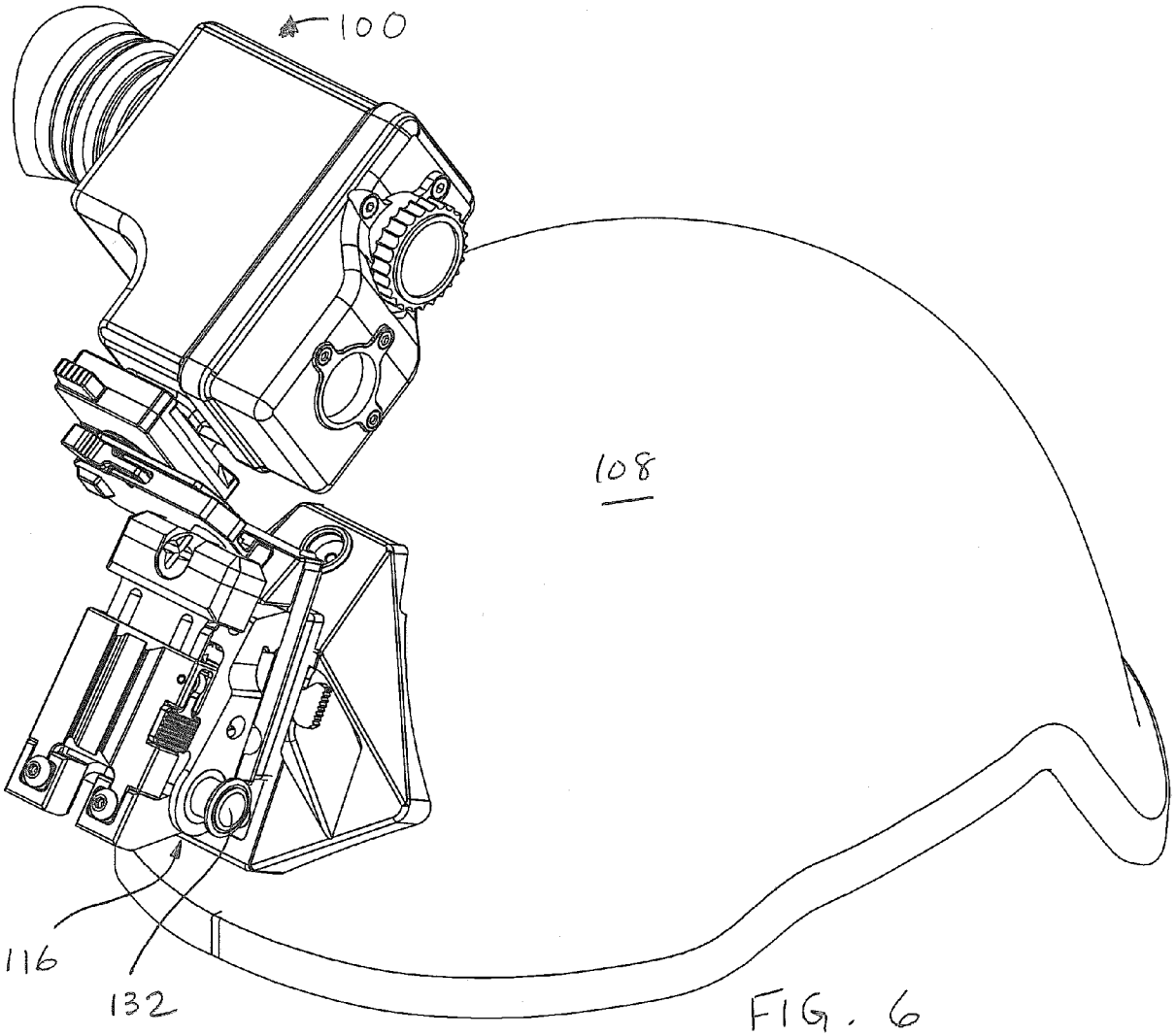
FIGS. 6 and 7 are isometric and side views, respectively, wherein the optical device is pivoted to a stowed position on the helmet.
Figure 7:
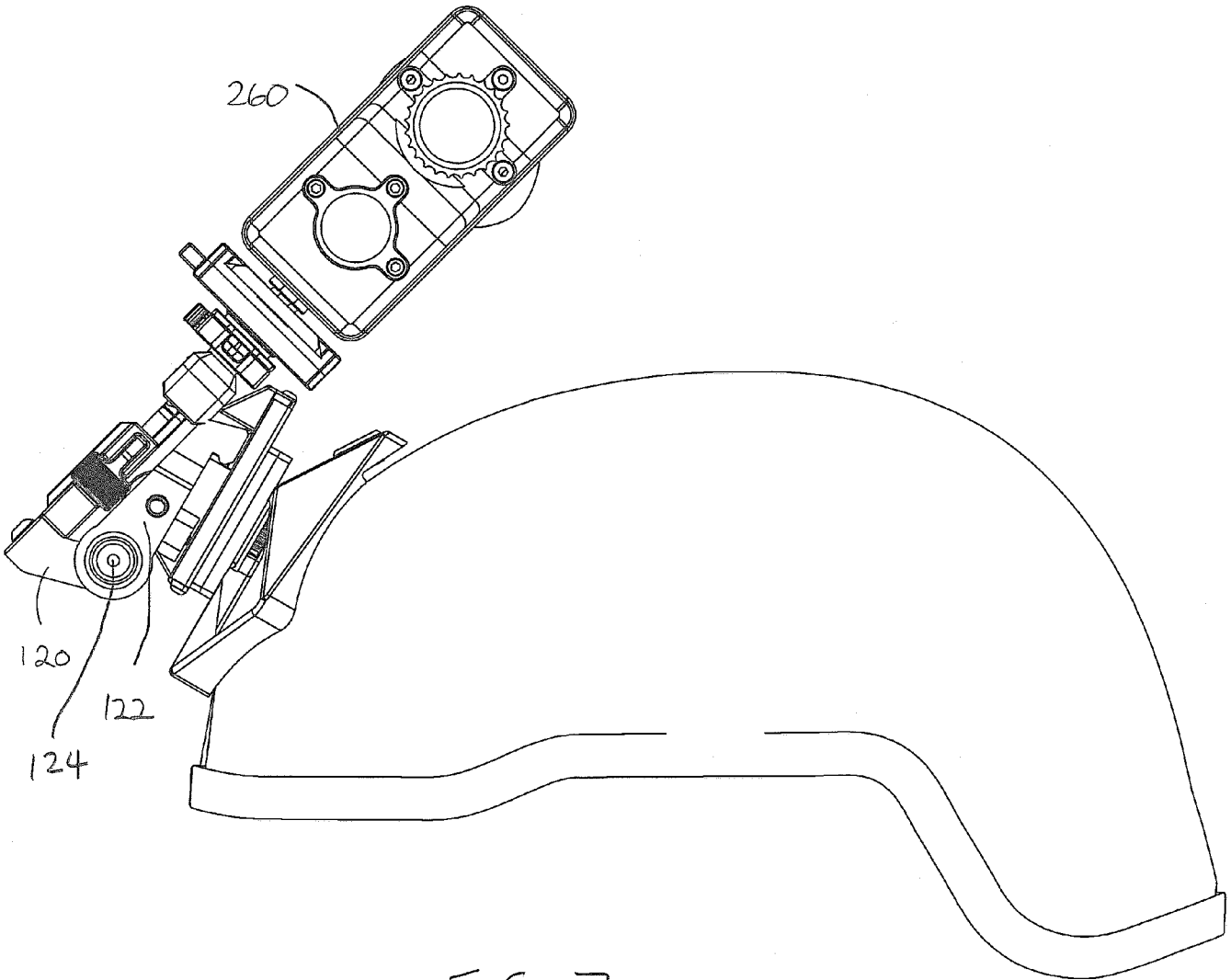
Figure 8:
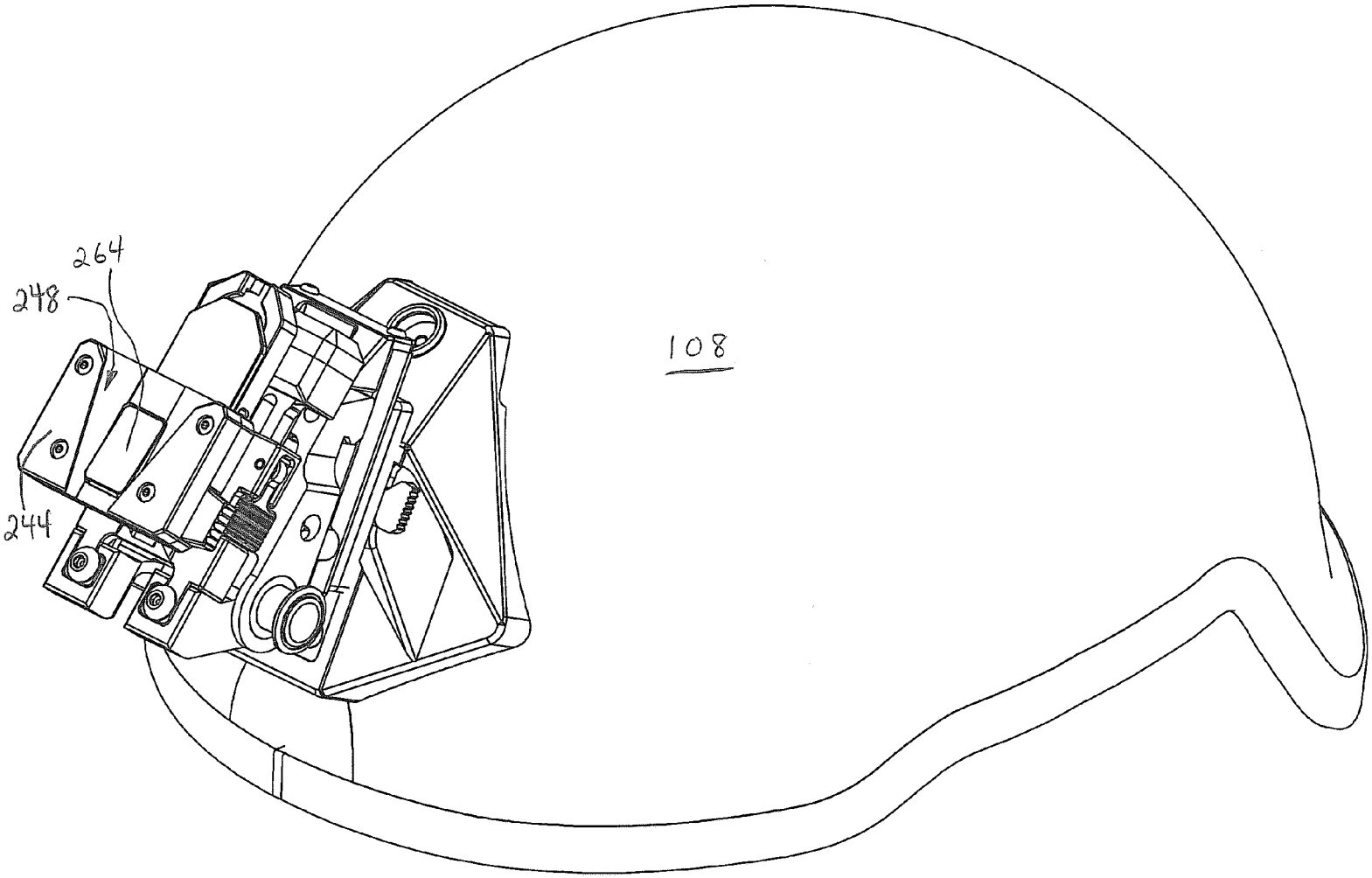
FIGS. 8 and 9 are isometric and side views, respectively, showing the optical device removed and the helmet mounting system in the stowed position on the helmet.
Figure 9:
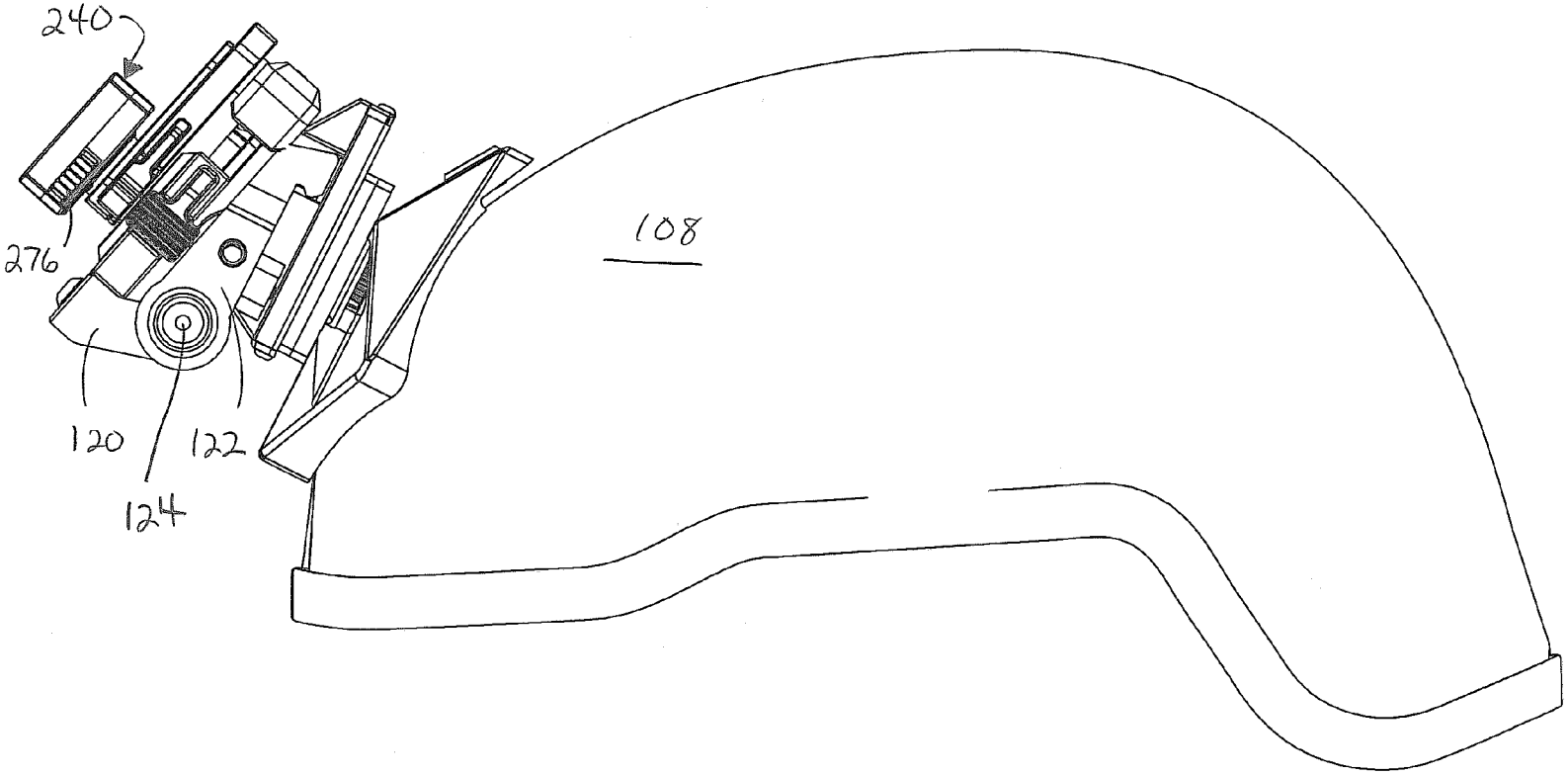

Referring now to the drawing FIGS. 1-12, wherein like reference numerals refer to like or analogous components throughout the several views, there appears an exemplary helmet mounting system embodiment 100, which includes a bracket 104 attached to the front portion of a helmet 108. The exemplary bracket 104 may be of the flush-mount, bayonet mounted bracket as described in the aforementioned U.S. provisional application No. 60/928,239 filed May 8, 2007, and incorporated herein by reference, although other brackets are also contemplated.

A breakaway base 112 is secured to the mounting bracket 104, e.g., via a bayonet mount in which a male bayonet mount member on the breakaway base engages a complimentary bayonet plate on the bracket 104. A bayonet lock release lever 113 is provided to release the breakaway base 112 from the bracket 104. A pivot arm assembly 116 is secured to the breakaway base 112 in breakaway fashion and may be as described in the aforementioned commonly owned U.S. Pat. No. 7,219,370, incorporated herein by reference. It will be recognized that other types of brackets, such as those shown and described in the aforementioned incorporated U.S. patent and applications.

The breakaway base 112 includes a sliding plate 114 which slides vertically with respect to an interface plate 110 engaging the bracket 104. A depressible button 118 allows the sliding plate 114 to slide with respect to the interface plate 110 to provide a vertical adjustment of the optical device relative to the eye of the user. Preferably, the vertical adjustment mechanism is of the gear rack/gear tooth type described in the aforementioned U.S. Pat. No. 7,219,370.

A breakaway lever 126 is pivotable between a first, breakaway position and a second, non-breakaway position. When the breakaway lever 126 is in the breakaway position, the engagement between the breakaway base and the pivot arm 122 is removably detachable, i.e., such that the pivot arm 122 will detach from the breakaway base upon the application of a predetermined force. When the lever 126 is moved to the non-breakaway position, the pivot arm 126 is rigidly attached to the breakaway base 112. The breakaway mechanism may be as described in the aforementioned U.S. Pat. No. 7,219,370.

An angle or tilt adjustment knob 128 is provided to allow the tilt angle of the optical device to be adjusted to a desired line of sight or optical axis, and may comprise a threaded knob rotatably engaging a threaded shaft running in an elongate or arcuate slot which may be selectively loosened for adjustment and then tightened when the tilt angle is at a desired position. The adjustment mechanism may be as described in the aforementioned U.S. Pat. No. 7,219,370.

Pivot arm assembly 116 includes pivot arms 120, which pivot relative to pivot arm 122 about a pivot axis 124. The pivot arms 120 are secured to a carriage member 129, e.g., via threaded fasteners 121. The pivot arms 120 are selectively pivotable between a lower operative position and an upper stowed position and are configured to remain in a selected position until a user depresses a pushbutton 132 to release the pivot arms and allow them to pivot about the pivot axis 124. Alternatively or additionally to the pushbutton release 132, the pivot arms may be configured to pivot in response to the application of some predetermined amount of force. The pushbutton 132 and the pivotal mechanism of the pivot arm assembly 116 may be as described in the aforementioned U.S. Pat. No. 7,219,370.

A first socket member 136 includes a sliding body 140 slidably received within grooves 144 formed in the carriage member 128. Sliding movement of the sliding body within the channels 144 provides a fore and aft adjustment mechanism for positioning the optical device at a desired distance from the user's eye. In the depicted preferred embodiment, the fore and aft positioning is infinitely adjustable. A cam lever 148 is rotatable about a pivot pin 152 and includes a cam peripheral surface 156 which exerts a force against the sidewall of the sliding body 140 to selectively securing the sliding body at a desired position within the channels 144.

The first socket member 136 also includes a first socket shell portion 160 which is secured to a second socket shell portion 164 via one or more threaded fasteners 168 and pins 172. The two shell halves 160 and 164 rotatably enclose a ball member 178 positioned at a proximal end of an optical device mounting arm assembly 176. The ball 178 is supported on a narrowed neck or stem 180, which extends through an opening or slot 184 formed in the base of the housing shell 160, 164 and extends 90 degrees, forming a 90-degree slot extending from the base of the shell 160, 164 to the front upstanding wall 188 of the shell 160, 164. Thus, the ball 178 may rotate freely about the y-axis (see FIG. 10). In additional to such rotation, the ball 178 may pivot 90 degrees with the stem 180 running in the 90 degree arcuate slot 184 formed in the housing shells 160, 164.

Figure 10:
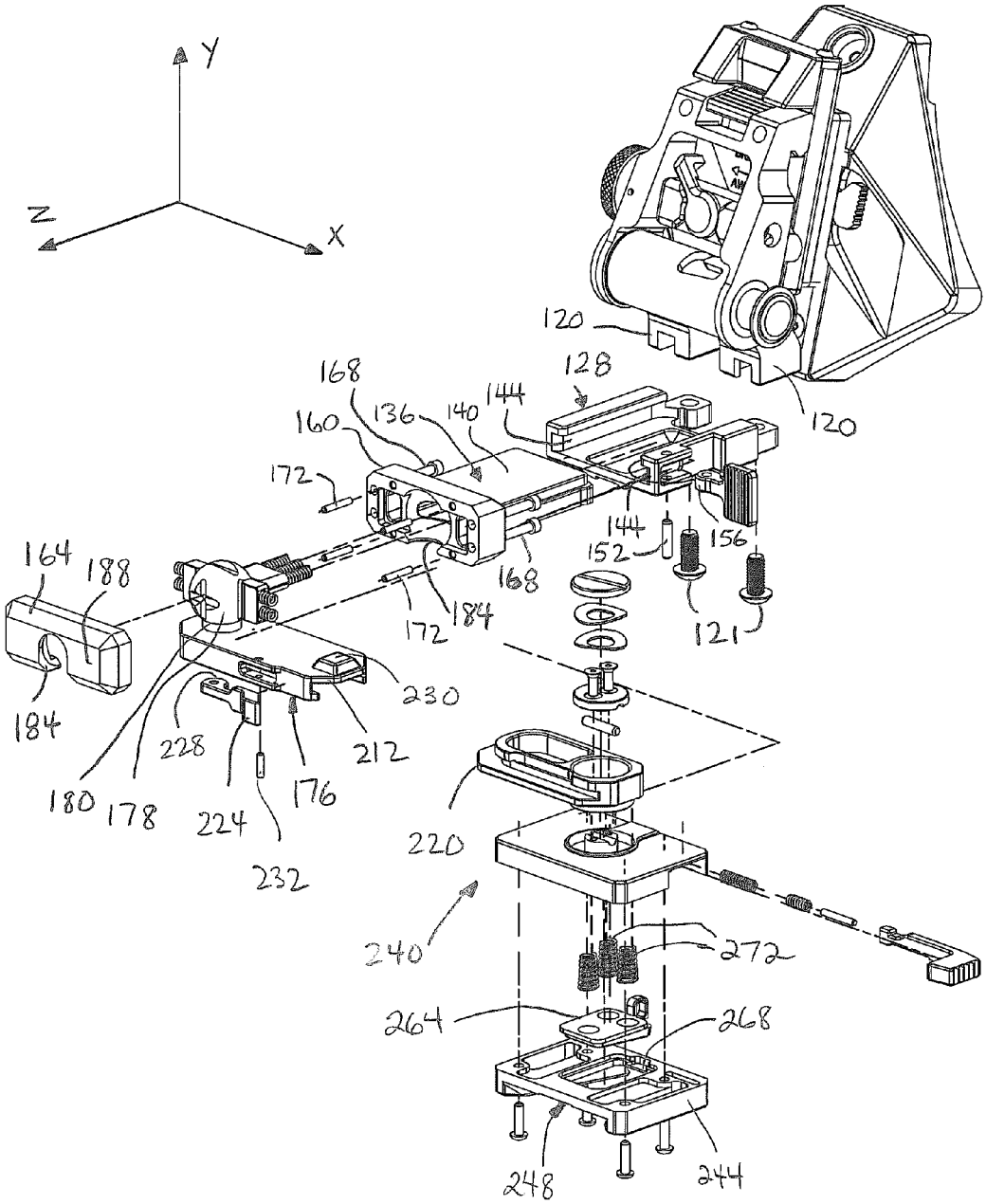
FIG. 10 is an exploded isometric view of the helmet mounting assembly appearing in FIG. 2.

Four vertical (in the orientation shown in FIG. 10) detents 196 are formed at 90-degree intervals on the ball 178 for selectively engaging vertical positioning members 200 captured within the shell cavity to provide positive retention of the ball at 90 degree intervals as the ball is rotated about the y-axis (see FIG. 10).

Similarly, three horizontal detents 204 are spaced about the ball at 90 degree intervals for selectively engaging a horizontal positioning member 208 received within the shell cavity to provide positive retention of the ball 178 at 90-degree intervals as the ball is rotated about the x-axis (see FIG. 10). Springs 192 and 194 are captured within the housing shells and resiliently urge the positioning members 200, 208, respectively, into an aligned one of the detents 196, 204, respectively.

The optical device mounting arm assembly 176 includes an outer arm member 212 extending from the stem 180 and defining channels or passageways 216 which slidably or telescopically receive an inner sliding arm member 220. A cam lever 224 is pivotally received within an aperture 226 in the outer arm member 212, and includes a cam surface 228. The cam lever 224 rotates about a pivot pin 232. The cam lever 224 is rotatable between an open position and a locked position. In the open position, the inner arm member 220 slides freely in the x-axial direction (see FIG. 10) with respect to the outer arm member 224. In the locked position, the cam surface 228 exerts a force against the inner arm member 220 to secure the inner arm member 220 at a desired position relative to the outer arm member 212. In this manner, the sliding or telescoping relationship of the inner and outer arm members provided a side-to-side adjustment mechanism so that the unit may be adjusted to position the optical device directly in front of the eye of the user. In the depicted preferred embodiment, this adjustment mechanism is infinitely adjustable in accordance with the intraocular distance of the user.

A protrusion 230, which is frustopyramidal in the illustrated embodiment, on the outer arm member is positioned to engage a like opening (not shown) in the carriage member 128 when the arm assembly 176 is pivoted to the stowed position without the optical device attached (see FIGS. 8 and 9), i.e., wherein the arm assembly 176 is pivoted about the y-axis toward the user and into alignment with the z-axis (relative to the orientation shown in FIG. 10).

An optical device mounting shoe assembly 240 is pivotally attached to the inner arm 220 at a distal end of the optical device mounting arm assembly 176. The mounting shoe assembly 240 includes a shoe member 244 having a dovetail or like receptacle 248 for removably receiving a complimentary mating member 252 of the optical device 260. A wedge member 264 is received within a counter bore 268 defining an aperture in the shoe member 244. One or more springs 272 (three in the embodiment shown) urge the wedge 264 downward into engagement with a complimentary aligned depression or receptacle (not shown) on the male mounting member 252 to removably secure an attached optical device 260 to the unit.

Figure 11:
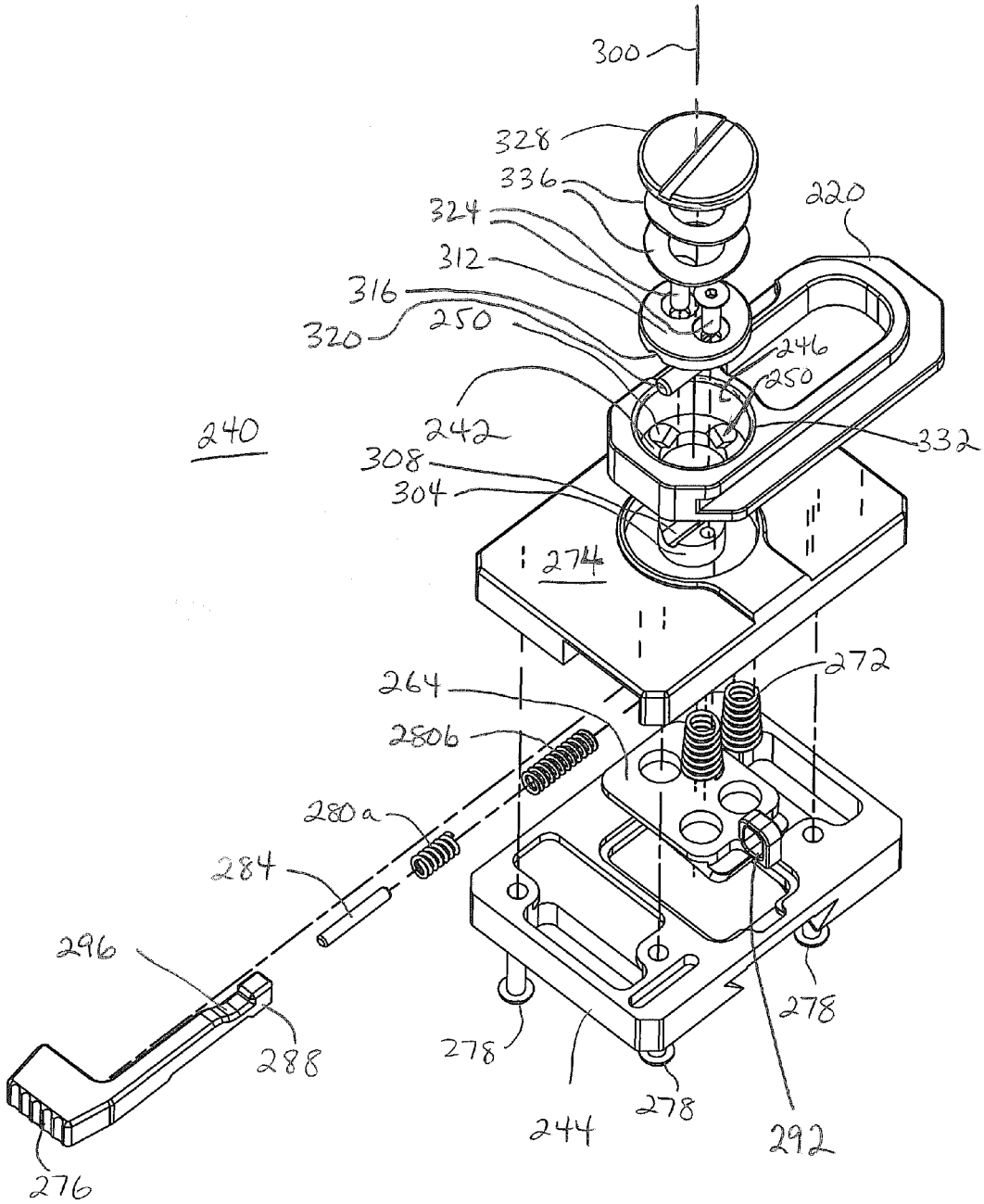
FIG. 11 is an enlarged, exploded view of the pivoting mounting shoe assembly.
Figure 12:
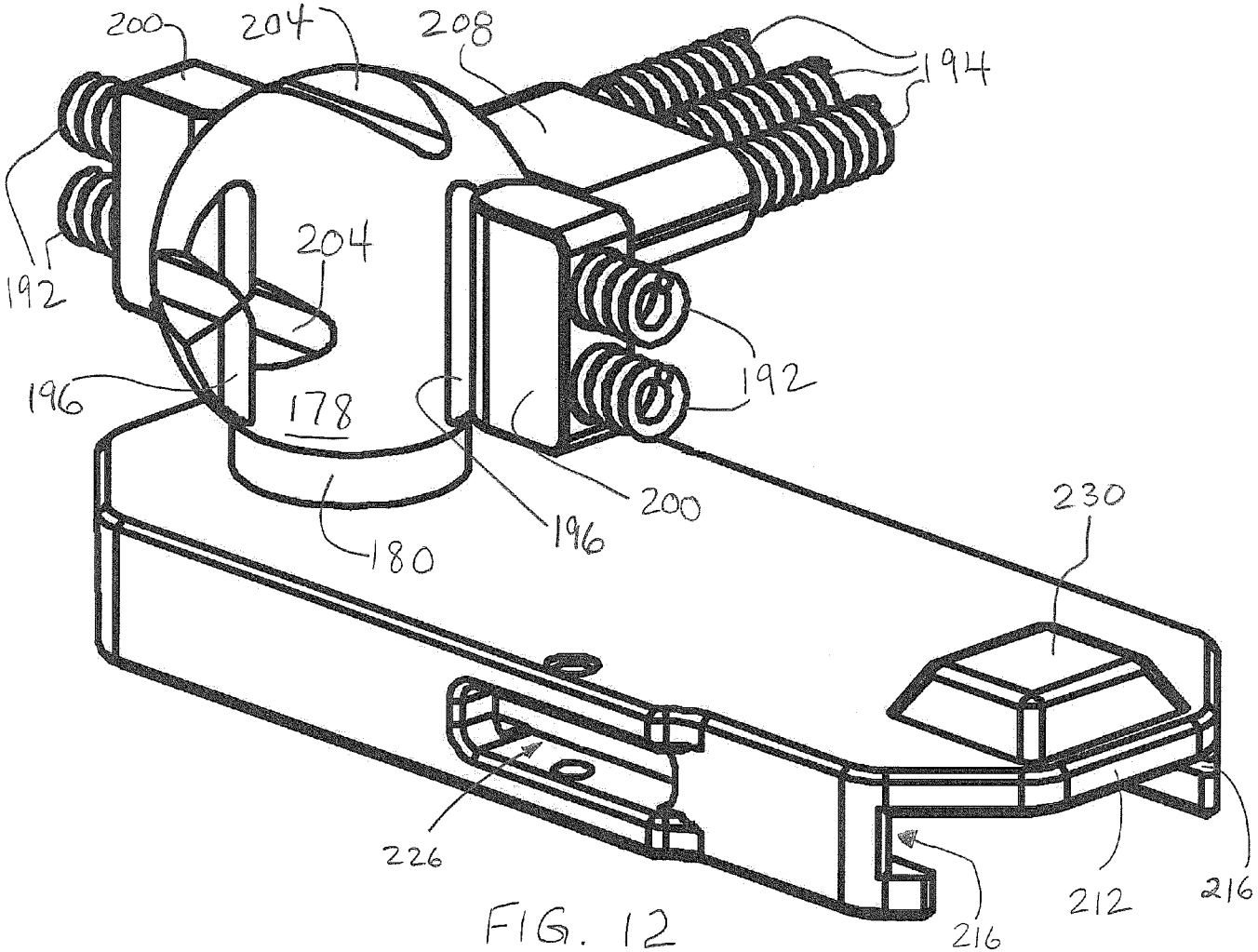
FIG. 12 is an enlarged view of the mounting arm with a uni-ball structure, with horizontal and vertical detents and corresponding aligned horizontal and vertical positioning members.

As best seen in FIG. 11, an inward flange 242 within an opening 246 includes recesses 250 to provide positive retention of the mounting shoe assembly at 90 degree spaced apart intervals for alignment with either eye of the user. The shoe member 244 is secured to an upper shoe member 274 via threaded fasteners 278 to capture the wedge 264 and springs 272 therebetween.

In operation, to move an attached optical device from one eye of the user to the other, the arm assembly is pivoted 180 degrees, thus rotating the ball 178 180 degrees about the y-axis and additionally rotating the optical device 180 degrees about the pivot axis 300. In this manner, the device may be used with either eye without the need to remove the optical device from the unit or for the use on any secondary attachment means.

In operation, to stow the unit on the helmet with the optical device attached (see FIGS. 6 and 7), the mounting shoe assembly 240 may first be rotated 90 degrees about the pivot axis 300 and the ball 178 is rotated 90 degrees about the x-axis (see FIG. 10), with the stem 180 running in the slot 184. The pivot arms 120 are then rotated about the pivot axis 124 as described above. By moving the device back farther on the helmet when the optical device 260 is not in use, neck strain is reduced.

To remove the optical device from the shoe assembly 240, a pushbutton 276 is inwardly depressed against the urging of one or more springs 280*a*, 280*b*, which are retained via a spring pin 284 in the illustrated embodiment. The pushbutton includes a distal end 288 received through an opening 292 in the wedge. An inclined surface 296 on the distal end 288 lifts the wedge 264 upward against the urging of the springs 272 to disengage the wedge from the receptacle formed on the male mounting member 252 to allow the device to be removed from mounting system.

The mounting shoe assembly 240 is pivotable about a pivot axis 300. A pivot assembly includes a cylinder 304 having a groove 308 and a disc 312 having a groove 316. A pin 320 is captured within an opening defined by the aligned grooves 308 and 316. The cylinder 304 and disc 312 are secured via threaded fasteners 324. As best seen in FIG. 11, the ends of the pin 320 ride on the inward flange 242, with the detents 250 providing fixed position points at 90-degree intervals as the mounting shoe assembly 240 is rotated about the pivot axis 300.

A threaded cap 328 engages a complimentary threaded opening 332 in the inner sliding arm and captures disc springs 336 therein. The disc springs urge the pin 320 into the detents 250 to provide positive retention of the optical device at 90 degree intervals as the optical device is rotated about the axis 300. Rotation of the threaded cap selectively advances or retracts the threaded cap to selectively increase or decrease the spring force exerted on the disc 312, and to thereby adjust the force needed to overcome the force of the disc springs 336 on the pin 320 and thereby rotate the optical device to a desired position.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A mounting device for mounting an associated optical device on an associated helmet, said mounting device comprising:

a first pivot arm assembly removably attachable to said associated helmet;

a second pivot arm assembly pivotally attached to said first pivot arm assembly, said second pivot arm assembly rotatable about a first horizontal axis; and an optical device mounting arm assembly rotatably attached to said second pivot arm assembly, said optical device mounting arm assembly rotatable relative to said second pivot arm assembly about a first vertical axis, said optical device mounting arm assembly including a ball rotatably received within a complimentary cavity formed in said second pivot arm assembly;

said ball rotatable about a vertical axis of said ball, the vertical axis of said ball being aligned with said first vertical axis; and a plurality of detents formed on said ball and spaced about the vertical axis of said ball for removably receiving one or more complimentary and resiliently biased engagement members received within said cavity for securing the optical device mounting arm assembly at a plurality of rotational positions about the vertical axis of said ball.

2. The mounting device of claim 1, further comprising:

said optical device mounting arm assembly being further rotatable about a second horizontal axis.

3. The mounting device of claim 1, further comprising:

each of said first and second horizontal axes extending in a transverse direction relative to a line of sight of a user.

4. The mounting device of claim 1, said optical device mounting arm assembly including:

a first member and a second member slidable with respect to said first member; and a locking member for selectively and releasably securing the second member at a desired position relative to the first member.

5. The mounting device of claim 1, further comprising:

said ball being rotatable about a horizontal axis of said ball, the horizontal axis of said ball being aligned with said first vertical axis; and a plurality of detents formed on said ball and spaced about the horizontal axis of said ball for removably receiving a complimentary and resiliently biased engagement member received within said cavity for securing the optical device mounting arm assembly at a plurality of rotational positions about the horizontal axis of said ball.

6. The mounting device of claim 1, further comprising:

said ball supported on stem which runs in an opening formed in a housing on said second pivot arm assembly defining said cavity.

7. The mounting device of claim 1, further comprising:

an optical device mounting assembly attached to said optical device mounting arm assembly, said optical device mounting assembly for removably attaching the associated optical device.

8. The mounting device of claim 7, further comprising:

said optical device mounting assembly including a mounting shoe for removably receiving a complimentary mounting foot of the associated optical device.

9. The mounting device of claim 7, further comprising:

said optical device mounting assembly rotatable about a second vertical axis.

10. The mounting device of claim 1, further comprising:

said second pivot arm assembly pivotable about said first horizontal axis between a first, deployed position and a second, stowed position.

11. The mounting device of claim 1, further comprising:

said second pivot arm assembly having a first adjustment member and a second adjustment member slidable with respect to said first adjustment member; and a locking member for selectively and releasably securing the second adjustment member at a desired position relative to the first adjustment member.

12. The mounting device of claim 1, further comprising:

a tilt adjustment mechanism for adjusting a tilt position of the associated optical device relative to an eye of a user.

13. The mounting device of claim 1, further comprising:

a mounting bracket on the associated helmet; and said first pivot arm assembly removably attachable to said mounting bracket.

14. The mounting device of claim 13, further comprising:

a connector for removably attaching said first pivot arm assembly to said mounting bracket.

15. The mounting device of claim 1, further comprising:

said first pivot arm assembly including a breakaway connector, said breakaway connector configured to release upon application of a predetermined force.

16. The mounting device of claim 1, further comprising:

said first pivot arm assembly including a breakaway connector, said breakaway connector selectively configurable between a breakaway configuration, wherein the breakaway connector is configured to release upon application of a predetermined force, and a nonbreakaway configuration.

17. The mounting device of claim 1, further comprising:

said first pivot arm assembly including a generally vertically slidable mounting base for providing a vertical adjustment of the associated optical device relative to an eye of a user.

18. The mounting device of claim 1, wherein the associated optical device is selected from a night vision goggle optical device and an electronic night vision goggle device.

* * * * *